US007845769B2

(12) United States Patent
Hollands

(10) Patent No.: US 7,845,769 B2
(45) Date of Patent: Dec. 7, 2010

(54) INK JET PRINTHEAD

(75) Inventor: Peter J. Hollands, Baarlo (NL)

(73) Assignee: OCÉ-Technologies B.V., Venlo (NL)

( * ) Notice: Subject to any disclaimer, the term of this patent is extended or adjusted under 35 U.S.C. 154(b) by 842 days.

(21) Appl. No.: 11/783,025

(22) Filed: Apr. 5, 2007

(65) Prior Publication Data

US 2007/0236540 A1 Oct. 11, 2007

(30) Foreign Application Priority Data

Apr. 7, 2006 (EP) ..... 06112383

(51) Int. Cl.
*B41J 2/045* (2006.01)
*B41J 2/05* (2006.01)

(52) U.S. Cl. ..... 347/70; 347/65

(58) Field of Classification Search ..... 347/47, 347/68–72, 65

See application file for complete search history.

(56) References Cited

U.S. PATENT DOCUMENTS 5,534,903 A 7/1996 Hayakawa et al.
5,907,340 A * 5/1999 Katakura et al. ..... 347/71
5,984,455 A * 11/1999 Anderson ..... 347/47
2004/0169704 A1 * 9/2004 Tobita et al. ..... 347/70

FOREIGN PATENT DOCUMENTS

| | | | |
|---|---|---|---|
| EP | 0 755 791 | A2 | 1/1997 |
| EP | 0 921 003 | A1 | 6/1999 |
| JP | 55-137975 | A | 10/1980 |
| JP | 3-118159 | A | 5/1991 |
| JP | 3-295657 | A | 12/1991 |
| JP | 4-27550 | A | 1/1992 |

* cited by examiner

*Primary Examiner*—Stephen D Meier
*Assistant Examiner*—Geoffrey Mruk
(74) *Attorney, Agent, or Firm*—Birch, Stewart, Kolasch & Birch LLP

(57) ABSTRACT

An ink jet printhead which includes a line of nozzles arranged with a uniform first pitch in a line direction X, a plurality of parallel ink channels having an axial direction normal to said line direction X and arranged in groups within which they have a uniform second pitch, each ink channel being connected to one of said nozzles, and a plurality of actuators arranged in groups corresponding to those of the ink channels, each actuator being associated with one of the ink channels for pressurizing ink contained therein for expelling an ink droplet through the associated nozzle, wherein the ink channels are connected to their associated nozzles by flow passages which all have a substantially equal length and are inclined relative to said axial direction with varying angles in both, said line direction X and a scan direction Z being orthogonal to the line direction and the axial direction.

11 Claims, 2 Drawing Sheets

INK JET PRINTHEAD

This application claims priority from European Patent Application No. 06112383.2 filed on Apr. 7, 2006, the entire contents of which is hereby incorporated by reference in its entirety.

BACKGROUND OF THE INVENTION

The present invention relates to an ink jet printhead, comprising a line of nozzles arranged with a uniform first pitch in a line direction X, a plurality of parallel ink channels having an axial direction Y normal to said line direction X and arranged in groups within which they have a uniform second pitch, each ink channel being connected to one of said nozzles, and a plurality of actuators arranged in groups corresponding to those of the ink channels, each actuator being associated with one of the ink channels for pressurizing ink contained therein, thereby expelling an ink droplet through the associated nozzle.

In a conventional ink jet printhead, the pitch of the nozzles is identical to the pitch of the ink channels, and the actuators, e.g., piezoelectric actuators, which are arranged with the same pitch, are made of a one-piece block of piezoelectric material which is cut in order to separate the individual actuators. The ink channels for all the nozzles of the printhead are formed by cutting grooves into a one-piece channel plate.

The width of such a printhead in the line direction X is necessarily constrained in view of considerations related to the (differential) thermal expansion of the actuator block and the channel plate, especially in the case of a hot melt ink jet printhead, and in view of the yield in the manufacturing process. When the width of the printhead is increased and, consequently, the number of nozzles, ink channels and actuators is also increased, the likelihood that at least one of the nozzles, ink channels or actuators is defective, will increase in proportion to the number of nozzles, and when only one of these elements is defective, the printhead must be discarded as a whole, so that the manufacturing yield becomes unacceptably low.

Theoretically, it would be possible to increase the width of the printhead, in order to provide a printhead extending over the whole width of a page, by aligning a plurality of printhead elements with the above construction in the line direction, so that their nozzles form a continuous nozzle array or line with a uniform pitch. However, for a printhead with a resolution of 75 dpi, for example, the pitch of the nozzles, and consequently also the pitch of the ink channels and the actuators is only in the order of 0.3 mm, and the printhead elements would have to be butted against one another in order to provide a continuous nozzle line with uniform pitch. As a consequence, the actuators for the first and the last nozzle of an individual printhead element would have to be arranged in the immediate proximity to the respective end of the printhead element, and it turns out to be difficult to manufacture a printhead element with such a construction. Moreover, if the actuator blocks of the aligned printhead elements are butted against one another, thermal expansion or contraction of the various components could still present a problem.

EP-A-0 921 003 discloses a printhead of the type described above, wherein the nozzles are offset from the center lines of their respective ink channels in the X-direction in such a manner, that the second pitch of the ink channels and actuators becomes smaller than the first pitch of the nozzles. As a result, it is possible to provide a wide printhead composed of a plurality of printhead elements or "tiles" which are disposed side by side, so that their nozzles form a continuous line with uniform pitch, whereas a larger spacing exists between the last actuator of one printhead element and the first actuator of the next printhead element. However, since each nozzle is formed directly at the end of the corresponding ink channel, the offset of the nozzle is limited to one-half the width of an individual ink channel. Thus, for a printhead element with a given number of nozzles, the difference between the pitch of the nozzles and that of the ink channels and actuators can only be relatively small.

EP-A-0 755 791 discloses an ink jet printhead in which each nozzle is connected to its associated ink channel and actuator by a flow passage that is inclined relative to the nozzle axis in the X-Y-plane. Thus, by varying the angle of inclination of the flow passages, it is possible to arrange the ink channels and actuators with a pitch that is different from the pitch of the nozzles. Then, however, the length of the flow passages varies in accordance with their angle of inclination, and this may give rise to non-uniformities in the printed image, because the different lengths of the flow passages induce differences in the process of droplet generation.

SUMMARY OF THE INVENTION

It is an object of the present invention to provide an increased design freedom for selecting the difference in the pitch of the nozzles and the pitch of the ink channels and actuators, without impairing the quality of the printed image.

According to the present invention, this object is achieved by an ink jet printhead of the type previously indicated, wherein the ink channels are connected to their associated nozzles by flow passages, all of which have a substantially equal length and are inclined relative to the axial direction Y with varying angles in both, said line direction X and a scan direction Z being orthogonal to the line direction and the axial direction.

Thus, according to the present invention, the flow passages are inclined two-dimensionally, i.e., not only in the X-Y-plane, but also in the Y-Z-plane. This makes it possible to make the pitch of the nozzles in the line direction X larger than the pitch of the ink channels and the actuators and yet maintain the length of the flow passages essentially constant, because an increased inclination of the flow passage in the X-Y-plane can be compensated for by a smaller inclination in the Y-Z-plane. Of course, this has the consequence that the nozzles are offset relative to the central axis of their ink passages not only in the X-direction but also in the Z-direction. However, the offset in the Z-direction can easily be compensated for by appropriately adapting the timings at which the actuators are fired when the printhead scans the recording medium.

As a result, it is possible to provide a printhead with a width as large as desired, wherein the nozzles are arranged with a uniform pitch in the X-direction, whereas the ink channels and the actuators form several groups wherein the pitch is constant and smaller than the pitch of the nozzles, but with larger spacings between neighboring ink channels that belong to different groups. As a consequence, the groups of actuators can be formed by separate arrays or blocks which have a width amounting only to a fraction of the total width of the printhead and which can easily be manufactured with a high production yield.

Since a channel plate having a very large width and, accordingly, a large number of ink channels, can be manufactured with a high production yield, e.g., by cutting parallel grooves into a one-piece graphite plate, it is possible that all the groups of ink channels of the printhead are formed in a one-piece channel plate which provides integrity and stability to the printhead, as a whole. On the other hand, since the number of actuators in a group in which the actuators are arranged with a uniform pitch is limited by production yield considerations, it is preferable that the actuators of different groups are formed by separate actuator arrays that will then be mounted in appropriate positions on the common channel plate. Likewise, the nozzles arranged in a line with a uniform pitch over the whole width of the printhead can be formed in a plurality of separate nozzle plates which can be manufactured with high production yield and can then be butted together like tiles on the common channel plate. In this way, it is possible to provide a page-wide printhead which can be manufactured with a high production yield and is robust against differential thermal expansion and contraction of its components.

The first pitch of the nozzles of such a printhead may be so small that the nozzles can be arranged with a density of 75 nozzles per 25.4 mm (75 npi; nozzles per inch). An even higher resolution of the printhead can be achieved by providing a plurality of nozzle lines, wherein the nozzles of one line are offset relative to the nozzles of another line. In a particularly preferred embodiment, the nozzle plates are provided with two continuous, parallel nozzle lines in which the nozzles of the respective line are offset by a half pitch, so that a resolution of 150 dpi is obtained. The ink channels associated with the nozzles of these two lines may be formed on opposite sides of one and the same channel plate. By providing two such 150 dpi printheads with appropriate offset, it is possible to obtain a printing resolution of 300 dpi.

In order to facilitate the control of the timings at which the actuators for the individual nozzles are energized, it is preferable that the offset of the nozzles in the scan direction Z, which offset is needed for making the lengths of the flow passages essentially uniform, fit into a predetermined raster, e.g., a 300 dpi raster. Then, the timings for firing all the nozzles of a line (or preferably of both lines) can be controlled on the basis of a common clock signal the period of which corresponds to one raster step in the scan movement of the printhead relative to the recording medium.

BRIEF DESCRIPTION OF THE DRAWINGS

The present invention will now be described in conjunction with the drawings, wherein.

DETAILED DESCRIPTION OF THE INVENTION

Figure 1:
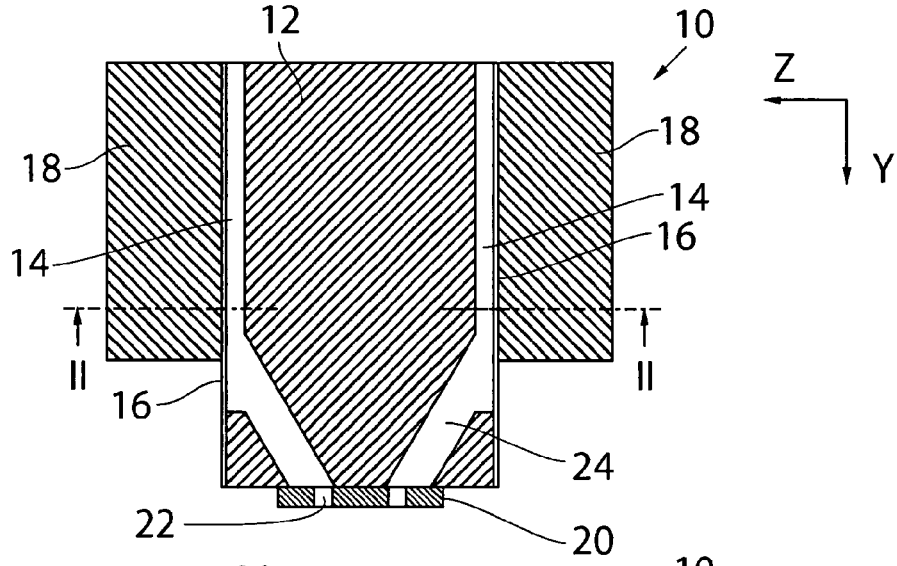
FIG. 1 is a schematic cross-sectional view of a printhead according to the present invention, the section being taken along the line I-I in FIG. 2.

As is shown in FIG. 1, an ink jet printhead 10 comprises a channel plate 12 which is made of graphite, for example, and has ink channels 14 formed by grooves that are cut into the surfaces on either side of the plate. The ink channels 14 have an axial direction Y that extents vertically in FIG. 1. The ink channels 14 are covered by flexible sheets 16 that are secured to the opposite surfaces of the channel plate 12. Each ink channel 14 is associated with a piezoelectric actuator 18 that is firmly attached to the outer surface of the flexible sheet 16.

A nozzle plate 20 with nozzles 22 formed therein is attached to an edge surface of the channel plate 12, and each ink channel 14 is connected to one of the nozzles 22 through a flow passage 24 that is bored through the graphite material of the channel plate. The flow passages 24 are inclined relative to the axial direction Y of the ink channels 14 in a scan direction Z, so that the flow passages coming from opposite sides of the channel plate 12 converge towards the nozzle plate 20. The ends of the ink channels 14 remote from the nozzle plate 20 are connected to an ink supply system (not shown), whereby the ink channels 14, the flow passages 24 and the nozzles 22 are filled with liquid ink. Capillary forces prevent the ink from flowing out through the nozzles 22.

By way of example, it can be assumed that the printhead 10 is a hot melt ink jet printhead, and that a heating system (not shown) is integrated in the channel plate 12 for maintaining the hot melt ink at a temperature above its melting point, e.g., at a temperature of about 100° C.

When, in the print process, an ink droplet is to be expelled from a selected one of the nozzles 22, a voltage is applied to the actuator 18 associated with that particular nozzle. The piezoelectric actuator contracts and draws the flexible sheet 16 away from the ink channel 14. As a result, the volume of the ink channel is increased and ink is drawn-in from the supply system. Then, when the voltage is removed or a voltage with opposite polarity is applied, the actuator 18 will expand and will flex the sheet 16 into the ink passage, thereby increasing the pressure of the ink, so that a pressure wave will propagate through the flow passage 24, and an ink droplet will be jetted from the nozzle 22 in a direction normal to the nozzle plate 20.

Figure 2:
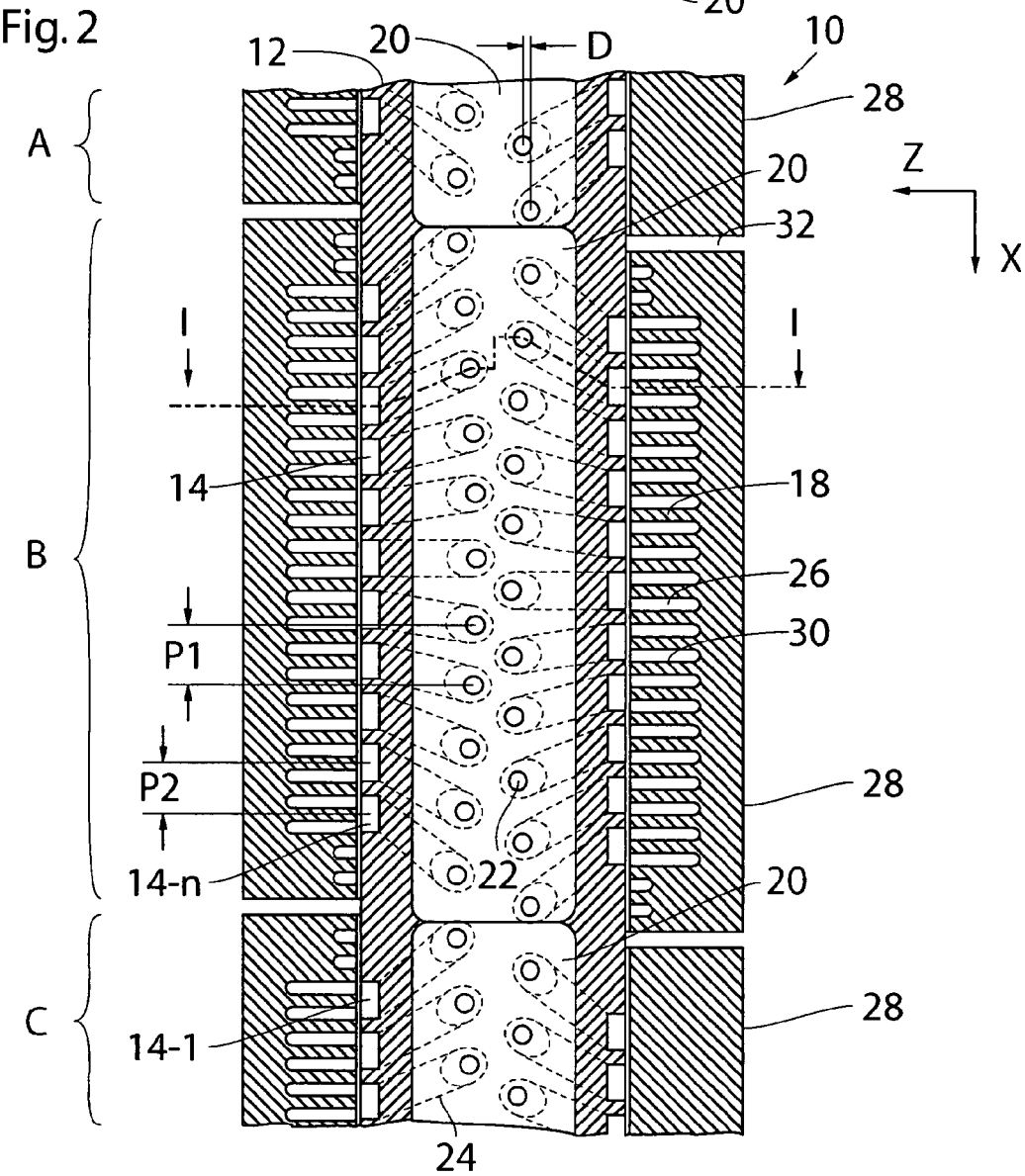
FIG. 2 is a front view of a portion of the printhead shown in FIG. 1, partially in section taken along linen II-II in FIG. 1.

As is shown in FIG. 2, the nozzle plate 12 is a continuous plate which extends in a line direction X over the entire width of the printhead and carries a plurality of nozzle plates 20 that are aligned in said scan direction X and are buttingly engaged with one another. The nozzles 22 are arranged in two approximately parallel lines extending in the line direction X. However, for reasons that will be explained later, these lines are not perfectly straight. A first pitch P1 is defined as the spacing between two neighboring nozzles 22 in X-direction. This pitch is uniform over the entire length of each nozzle line, even across the junctions between adjacent nozzle plates 20, and amounts to 0.34 mm in this example, corresponding to a nozzle density of 75 nozzles per 25.4 mm (75 npi; nozzles per inch).

As can be further seen in FIG. 2, the ink channels 14 are arranged in groups A, B and C, and within each group, the ink channels are arranged in parallel in the axial direction Y and with a uniform second pitch P2 in the line direction X. The second pitch P2 is smaller than the first pitch P1. This has the effect that the spacing in the X-direction between, for example, the last ink channel 14-*n* of the group B and the first ink channel 14-1 of the group C is significantly larger than P2 and even significantly larger than P1. Here, n is the number of ink channels 14 within a single group, i.e., n=11 in the example shown. In a practical embodiment, however, n would be as large as 130, for example, so that the width of a single group of ink channels (such as group B) would amount to approximately 44 mm.

The actuators 18 are also arranged in groups, corresponding to the groups of ink channels. As can further be seen in FIG. 2, the actuators 18 are formed by cutting deep parallel grooves 26 into a one-piece actuator block 28 of piezoelectric ceramic. Since the number of grooves 26 is twice the number of actuators 18, the fingers remaining between the grooves 26 form not only the actuators 18 but also support fingers 30 which connect the actuator block 28 to the portions of the channel plate 12 remaining between adjacent ink channels 14.

Since the pitch P2 is smaller than the pitch P1, the actuator blocks 28 can be made so short that gaps 32 are formed between adjacent blocks 28 and, nevertheless, the first and the last grooves 26 of each block are safely spaced away from the ends of the block. This greatly facilitates the manufacturing process for the actuator blocks and permits a high production yield. Moreover, the gaps 32 can absorb differential thermal expansions and contractions of the actuator blocks 28 and the channel plate 12.

Since each of the flow passages 24 must connect an ink channel 14 to its associated nozzle 22, it is necessary for the flow passages 24 to fan-out towards the nozzles 22 in the line direction X. Thus, the flow passages 24 are inclined not only in the Z-direction, as shown in FIG. 1, but also in the X-direction, as is shown in FIG. 2, and the angle of inclination in the X-direction increases progressively from the center of each block (block B for example) towards the ends thereof.

Would the nozzles 22 be arranged exactly on two straight lines, then the flow passages 24 would differ significantly in their length because of the different angles of inclination. However, in the shown embodiment, the angle of inclination in the Z-direction is also varied and becomes larger when the angle of inclination in the X-direction becomes smaller. This is why the nozzles 22 of the same line have an offset D in the Z-direction, as is shown in FIG. 2. Looking, for example, at the group B in FIG. 2, it can be seen that the two approximately parallel nozzle lines are closer together near the center of the group B and progressively separate from one another towards the ends of the group. In this way, it can be achieved that all the flow passages 24 have at least approximately the same length. As a result, the propagation of pressure waves in the ink channels 14 and the flow passages 24 will follow an identical pattern for all the nozzles 22.

In order to make the length of all flow passages 24 equal to one another, it may be considered that the central axis of the flow passages lie on the surface of an imaginary cone, the axis of which coincides with the central axis of the ink passage 14, and, when going from one ink channel to another, the flow passage 24 is rotated about the axis of the cone.

In the example shown in FIG. 2, the positions and widths (in the X-direction) of the nozzle plates 20 correspond to the positions and the widths, respectively, of the groups of ink channels and actuator blocks. It is possible, however, that the nozzle plates 20 are offset relative to the actuator blocks 28 in the X-direction and/or the width of the nozzle plates in the X-direction is smaller or larger than the width of the actuator blocks.

As is further shown in FIG. 2, the nozzles 22 of the two nozzle lines are offset relative to one another in the X-direction by one-half of the first pitch P1, so that the effective nozzle density of the printhead 10, as a whole, corresponds to 150 npi.

Figure 3:
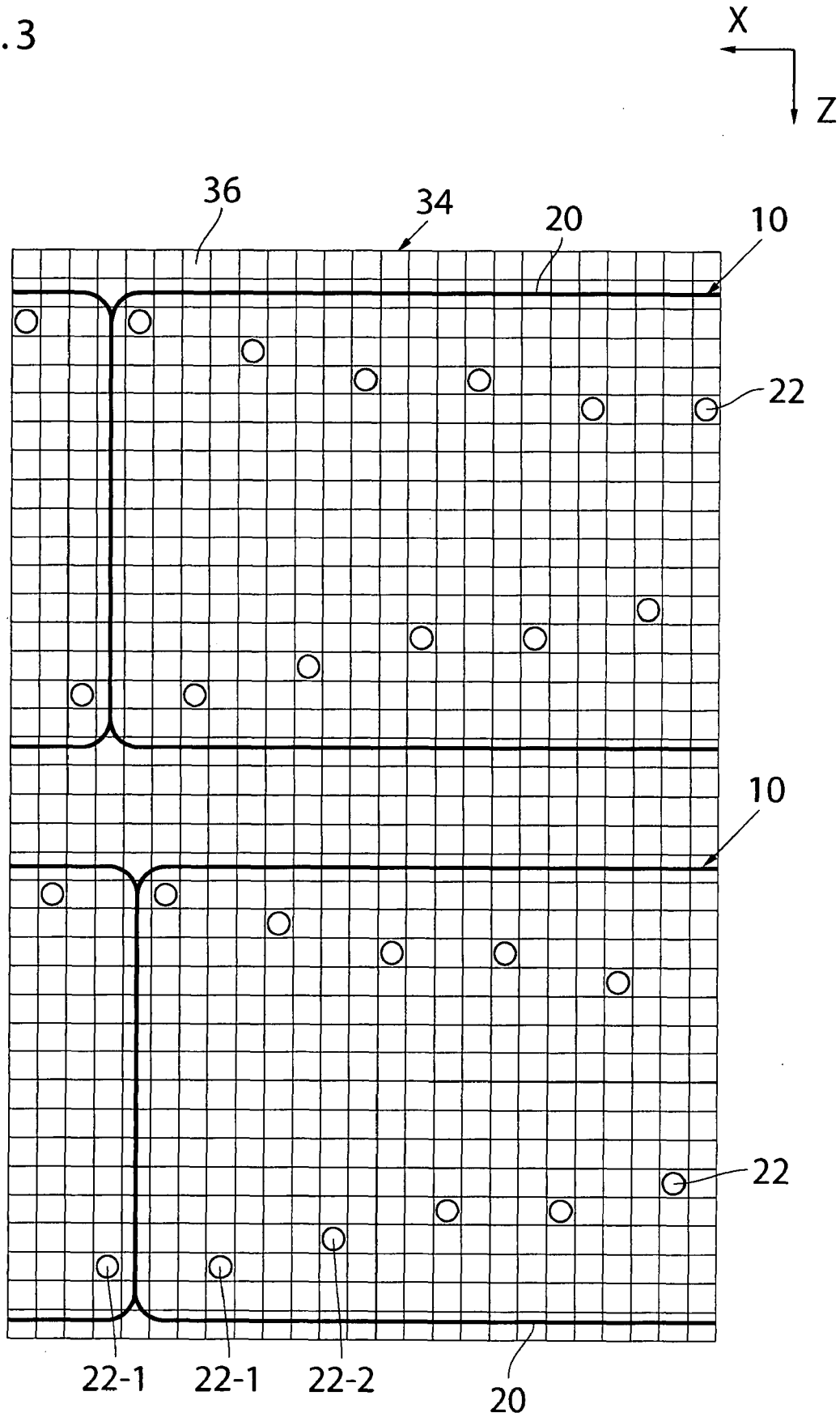
FIG. 3 is a schematic front view of a combination of two printheads in relation to a pixel raster of an image to be printed.

By arranging two of the printheads 10 in parallel, with an appropriate offset, it is possible to achieve a resolution of 300 dpi. This has been exemplified in FIG. 3, where a schematic front view of two printheads 10 (represented by their nozzle plates 20) has been shown relative to a pixel matrix 34 which represents a 300 dpi pixel raster of an image that can be printed with the combination of the two printheads 10.

The two printheads 10 are mounted on a frame (not shown) in fixed spatial relation relative to one another and are moved relative to a recording medium, e.g. a sheet of paper onto which the image is to be printed, so as to scan the paper in the scan direction Z. In the line direction X, both printheads 10 may extend over the entire width of the paper, so that a high printing speed can be achieved by scanning the sheet in only one direction.

The square matrix elements of the pixel matrix 34 having a 300 dpi resolution correspond to individual pixels 36 and have a width and height of $^{25.4}/_{300}$ mm ($^{1}/_{300}$ inch). This width will be called one "raster step" in the following.

The pitch P1 of the nozzles 22 of a single nozzle line corresponds to four raster steps. The nozzles of the two lines that are formed in the same nozzle plates 20 are offset relative to one another in the X-direction by two raster steps, and the two nozzle plates 20 are offset in the X-direction by one raster step, so that each pixel 36 on the sheet can be printed when this sheet is scanned once with the two printheads. The timings at which the individual nozzles are fired are coordinated with the scan movement, so that the pixels are printed in the correct positions in the Z-direction.

As an example, it shall be assumed, that the two printheads scan the sheet of paper in a positive Z-direction (downward direction in FIG. 3), and that a continuous image line shall be printed, this line extending in the X-direction and having a width of one pixel. Then, the two nozzles designated as 22-1 in FIG. 3 will be the first to be fired. When the printheads have been moved by one raster step, the nozzle 22-2 will be fired, then, after another raster step, the next two nozzles, and so on. In this way, every fourth pixel of the image line will be printed with the lowest nozzle line of the lowest nozzle plate 20 in FIG. 3. Then, the gaps will successively be filled with the nozzles in the upper nozzle line of the lower nozzle plate and then with the nozzles of the upper nozzle plate 20, so that the continuous image line is completed.

In this embodiment, the control of the actuators for the various nozzles is facilitated by the fact that the nozzles are adapted to the raster of the pixel matrix 34, not only in the line direction X but also in the scan direction Z, so that the timing at which the nozzles have to be energized correspond to fixed raster positions of the printheads.

The requirement that the nozzles 22 fit into a discrete two-dimensional pixel raster implies that the angles at which the flow passages 24 are inclined in the Z-direction cannot be chosen arbitrarily. As a result, the lengths of the various flow passages 24 cannot be exactly equal, but slight deviations in length must be accepted. Nevertheless, the quality of the printed image will be significantly improved in comparison with the case where all nozzles of the nozzle line were arranged on a straight line, without any offset in the Z-direction. When the resolution of the printer is as high as 300 or 600 dpi, for example, the pixel raster will be so fine that the length differences between the individual flow passages 24 become negligibly small.

In a modified embodiment, the nozzles 22 may be arranged in only a single line, with a pitch of one half of P1 and with the flow passages 24 coming alternatingly from the opposite sides of the channel plate 20.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim.

The invention claimed is:

1. An ink jet printhead comprising a line of nozzles arranged with a uniform first pitch (P1) in a line direction X, a plurality of parallel ink channels having an axial direction Y normal to said line direction X and arranged in groups (A, B, C) within which they have a uniform second pitch (P2), each ink channel being connected to one of said nozzles, and a plurality of actuators arranged in groups corresponding to those of the ink channels, each actuator being associated with one of the ink channels for pressurizing ink contained therein, thereby expelling an ink droplet through the associated nozzle, wherein the ink channels are connected to their associated nozzles by flow passages which all have a substantially equal length and are inclined relative to said axial direction Y with varying angles in both, said line direction X and a scan direction Z being orthogonal to the line direction and the axial direction whereby said flow passages are inclined two dimensionally in a X-Y plane and a Y-Z plane.

2. The printhead according to claim 1, wherein the actuators are piezoelectric actuators.

3. The printhead according to claim 1, wherein each group of actuators is formed by a separate actuator block.

4. The printhead according to claim 3, wherein the actuator blocks are separated by gaps.

5. The printhead according to claim 3, wherein, as seen in the line direction X, the distance between an end of the actuator block and an actuator closest to that end is larger than the second pitch (P2).

6. The printhead according to claim 1, wherein the ink channels of the plurality of groups (A, B, C) are formed in a common channel plate.

7. The printhead according to claim 1, wherein the ink channels are formed by grooves in a surface of a channel plate, the nozzles are formed in at least one nozzle plate that is attached to an edge of the channel plate, and the flow passages are formed by through-bores in the channel plate.

8. The printhead according to claim 1, wherein the flow passages are formed on opposite sides of the channel plate.

9. The printhead according to claim 8, wherein the nozzles are arranged in two substantially parallel lines, with the X-direction offset by one half of the first pitch (P1) between the nozzles of two lines.

10. The printhead according to claim 1, wherein the line of nozzles extends with a uniform pitch over a plurality of nozzle plates.

11. The printhead according to claim 1, wherein an offset (D) in the scan direction Z between neighboring nozzles of the same nozzle line corresponds to an integral number of discrete raster steps.

* * * * *